US005082013A

United States Patent [19]

Scheib

[11] Patent Number: 5,082,013

[45] Date of Patent: Jan. 21, 1992

[54] FIREFIGHTING WATER DELIVERY SYSTEM AND METHOD

[76] Inventor: John R. Scheib, 1216 Sailfish, Hitchcock, Tex. 77563

[21] Appl. No.: 541,338

[22] Filed: Jun. 21, 1990

[51] Int. Cl.[5] ..... E03B 7/00; E03B 9/02

[52] U.S. Cl. ..... 137/1; 137/236.1; 137/272; 137/899; 405/41

[58] Field of Search ..... 405/36, 39, 127, 40, 405/41, ; 137/236.1, 899, 272, 1, 356; 141/387; 248/49

[56] References Cited

U.S. PATENT DOCUMENTS

| | | | |
|---|---|---|---|
| 241,937 | 5/1881 | Creuzbaur | 137/236.1 |
| 3,780,750 | 12/1973 | Perkins | 137/236.1 |
| 3,799,217 | 3/1974 | Bauer | 141/387 |
| 4,180,348 | 12/1979 | Taylor | 405/39 |

FOREIGN PATENT DOCUMENTS

| | | | |
|---|---|---|---|
| 668268 | 11/1938 | Fed. Rep. of Germany | 137/272 |
| 456900 | 6/1913 | France | 137/236.1 |
| 861850 | 2/1941 | France | 141/387 |
| 579966 | 11/1977 | U.S.S.R. | 405/39 |

*Primary Examiner*—A. Michael Chambers

*Attorney, Agent, or Firm*—Alton W. Payne

[57] ABSTRACT

A system consisting of multiple independent units each of which includes two standard fire hydrant connections located on two riser pipes and an interconnecting underground pipe providing a means for drafting tide, lake or river water from a streetside conneciton. Any pumper/tanker truck can thus connect a suction hose to the streetside riser and draft water through a second suction hose with one end connected to the riser at a bulkheaded waterside location and the other end equipped with a strainer is lowered into the water source. Standard lengths of fire hose suffice at both water and streetside connections when the water is bulkheaded and water level variations are sufficiently small that the lift capability of the pump is not exceeded. Pumping many begin when connections are complete. Backflushing with fresh water carried on the pumper/-tanker may be performed if the pump is not well sealed and pumping begins after backflushing is complete and flow direction is reversed. Risers and connecting pipe are left full of fresh, potable, chlorinated water to eliminate marine or aquatic biological fouling and are capped when not in use. Additional biocide may be added to the system if necessary.

18 Claims, 1 Drawing Sheet

FIREFIGHTING WATER DELIVERY SYSTEM AND METHOD

FIELD OF THE INVENTION

This invention relates generally to a system for providing an abundant and reliable water supply from a body of water to one or more fire trucks for the purpose of extinguishing fires and a method associated therewith. More particularly, the present invention relates to a system for providing an abundant and reliable water supply for application in locations where residential, commercial or industrial property is located adjacent to tidal, lake or river water.

BACKGROUND OF THE INVENTION

The invention relates to the concept of making it possible for any pumper/tanker truck with standard NFPA 1901 equipment to draft water from a location remote from a water bulkhead by making a suction hose connection to a streetside fire connection, thereby avoiding the need to locate the truck at the bulkhead. The purpose is to provide an unlimited water supply with capacity, reliability and convenience at least the equal of a water main/fire hydrant system at a greatly reduced cost.

There are numerous residential, commercial and industrial communities located along the coastal areas, for example, the Gulf of Mexico, in which the real estate has been created by dredging and bulkheading. In general, such properties consist of peninsulas and other land forms bordered by dredged canals along which means have been provided to protect the banks from erosion and to provide adequate depth at waterline for easy access to barges, boats and ships. It is usual that streets are located along the center of the peninsula on the opposite side of individual properties from the canal or other water surface.

For peninsular property in particular, it is very difficult and extremely expensive t provide a properly looped potable water system, which maintains proper protection of health standards for potable water and, at the same time, provide adequate firefighting water at standard hydrants. The initial installation of water mains and fire hydrants that comply with firefighting standards and with standards for potable water systems is frequently, therefore, either neglected or substandard, and retroactive installation or expansion of existing systems is exceptionally expensive.

The usual approach to obtaining firefighting water in these circumstances is to use pumper/tanker trucks to draft water directly from the canals or other adjacent water source. Depending on how close the truck can get to a bulkhead, the truck can be attached with one ore more lengths of suction hose with a strainer to the suction intake of the hose, drop the strainer end of the hose into the water, and begin pumping, provided the pumper has sufficient lift capacity and the strainer is designed to prevent clogging of the pump. In many coastal regions, e.g., along the coast of the Gulf of Mexico tidal variations are minimal with low tide seldom being more than two feet below mean high tide. Thus, the water-to-pump intake vertical separation near the bulkhead is seldom more than seven to eight feet. Connecting the truck directly to the water source works well, then, unless rains have rendered the bulkheaded property impassable and until such time as properties are developed to the point where access is limited by structures, fences, etc. Under these latter conditions, firefighting water will not be available by direct draft without excessive pumping distance and commensurate increase in the time required to initiate firefighting operations.

The purpose of the present invention is to avoid any problem relating to the accessibility of the tidal, lake or river water intended to supply the firefighting system. This is done by locating interconnecting risers at both the street and bulkhead to which standard NFPA 1901 suction hose connection using standard suction hose lengths are made which provide a continuous fluid path from the water to the street. Accessibility is then assured from a streetside connection as normally employed in water main/fire hydrant systems, regardless of those factors which would affect direct drafting from a truck located at the bulkhead.

In most residential areas adjacent to a body of water, the bulkheaded property grade level is 6 to 8 feet above mean high tide, and street elevations are comparable. In coastal areas which are subject to tropical storms, residences are predominantly built to comply with laws or regulations governing their construction; i.e., the living areas are built 12 to 16 feet above mean high tide and are, therefore, buttressed or built on columns. Typically only part of the ground floor is enclosed such that at least part of the underside of the main floor is exposed. Because of the high cost of this "manufactured" real estate, parcels of land are small and residences are built close together, e.g., with a 10 feet separation being frequent. Because of the elevated main floor, the construction tends to be predominantly frame. A community built of such structures creates an ideal situation for the rapid inducement and spreading of fires from structure to structure. Adequate fire protection, thus, requires an abundant source of water, fast application of the water to the fire and a high degree of reliability of water delivery to the fire.

Commercial and industrial activities located at waterside are similarly protected from storm tides and waves by construction at elevated heights. Light structures may be set on columns as is common for residences, but warehouses and factories may be set on an elevated grade such that air to feed the fire is more restricted. However, dockside warehouse and factory fires in such activities involve large buildings with a great deal of open space among the contacts such that fires are difficult to control once started, and they require a multiplicity of hydrants and trucks for adequate fire control. The present invention makes it possible and economical to provide for (1) as many sources of water as may be predictably required, (2) with sources located with maximum flexibility, and (3) each capable of supplying water to the maximum capacity of the pumpers. Where an elevated grade results in a need to exceed the lift capacity of an NFPA 1901 standard pumper truck, which is 25 feet, variations in the present invention may be necessary, but are readily apparent. For example, longer suction hoses than those normally carried by the pumper truck can be permanently connected at the waterside location which can be dropped into the water when needed. Alternately, pumps can be permanently installed which direct the water to the streetside or other location of the riser placed for truck connection.

In the many waterside communities and activities for which the present invention is suited, the supply of firefighting water is limited only by the number of pumper/tanker trucks that can be brought to the scene and connected to the natural water source. The reliability of the delivery of that water to a fire is a function of the lift and pumping capacity of the truck(s) at the scene, the availability of trained personnel, and one section of suction hose per truck which is equipped with a strainer at one end. However, any certified pumper/tanker truck has both the lift and pumping capacity to implement the water delivery system of the present invention in the vast majority of waterside communities, and strainers are standard on the required drafting hose carried on pumpers.

With respect to the initial use of the present invention, training is not a problem since the risers associated with the water delivery system of the present invention emulate a standard fire hydrant. Further, both the equipment and procedures associated with the present invention are NFPA 1901 standard. The connection of the water delivery system of the present invention to a pump truck is identical to the connection of a pump truck to a standard fire hydrant, therefore comprising a very simple system for dependable water delivery.

Factors to be considered are (1) the vertical distance from the pump truck intake to the water level, (2) the horizontal distance between the waterside and street-side risers, and (3) the need to lower the suction intake to at least 18 inches below the water surface to prevent cavitation. However, unless grade level has been raised well above that normally employed, especially in residential communities, vertical distance is not a problem for NFPA 1901 standard pumper trucks. Horizontal distance is not a problem in narrow peninsular communities, but for other dockside activities a practical limit of about 250 feet might be imposed unless a second pumper is available as a booster or larger diameter hose is used. Obtaining approximately 18 inches submersion of the suction intake is rarely a problem since bulkheads are designed to provide for boat, barge, etc. access at waterside.

Thus, compliance with applicable regulates can be assured for successful use of the present invention. Effective, reliable, affordable fire protection, the flexibility of location of the truck intake risers, the NFPA 1901 standard features and the economy of the system thus qualify the present invention as an acceptable alternative to water mains and fire hydrants for applications as described herein. Additionally, the unlimited water supply and the ease and economy of installing as many units as the situation may demand, even retroactively, means that redundancy of sources and fire trucks may be used to increase the level of protection to that demanded by the situation, including the increase of the number of firefighting units that can concurrently fight a fire such that pump failure can be eliminated as a significant factor affecting reliability.

For the applications described, effective and reliable fire protection demands both the previously emphasized compatibility with NFPA 1901 standard firefighting equipment and absolute immunity from fouling of the system. Physical fouling is prevented by the strainer on the suction hose intake. By isolating the connection from the waterside riser to the natural water source until the time of a fire, marine or aquatic biological fouling is avoided which previously has resulted in the failure of in-place drafting systems. Water left in the system for the purpose of minimizing the time required to begin pumping is fresh, potable, chlorinated water and is isolated from oxygen and sunlight so that fouling from biological growth is eliminated; this can be further enhanced by the addition of inexpensive chemicals such as bleach if chlorinated water is not available.

The present invention addresses features not previously addressed. These features include the ability to back flush the the water delivery system in an attempt to remove strainer blockage from the water side hard suction hose and the face that all NFPA approved fire trucks will carry these hard suction hoses as standard equipment. Firemen being knowledgeable in the use of said hard suction hose, will have no difficulty using this invention.

In addition to providing unlimited firefighting water, it does so at greatly reduced cost as compared with standard water mains and fire hydrants and, further, permits installation at any time; i.e., it can be installed when construction in the community has progressed to the point that it is needed. The ease with which a community can retrofit the installation of the water delivery system of the present invention avoids the time and ultimate monetary cost associated with the installation of standard mains and hydrants. The minimum cost saving is approximately ten to one when comparing the water delivery system of the present invention with presently prescribed looped mains and hydrants. Further, any level of reliability can be provided by increasing the number of fire pumper trucks or the density of installations. Since each unit of the water delivery system of the present invention is totally independent of the other units and independent of the potable water supply, there is not practical limit to the density of units within a community—other than the amount of money the community wishes to commit to fire protection. This feasible redundancy of units can offer great increases in reliability proportional to the number of pumper/tanker trucks available, and it is especially important in this regard when a multiplicity of trucks are required to control a massive fire since there is no effect of one truck on the supply of water to the others.

In a massive fire situation, a serious water supply problem may exist with respect to standard pressurized water main/fire hydrant systems. The water pressure associated with the potable water system is not effected by the use of this invention, thereby eliminating the potential drop in water pressure due to the demand for water in fighting one or more fires. The use of the present invention adds to the safety of the potable water system since there is no involvement of the potable water system, thereby eliminating the risk of contamination due to fire fighting use. Further, since the invention does not involve the potable water system, there is no consumption of vital, and possible scarce, potable water for use in firefighting.

One skilled in the state of the art will recognize that the unique results described have been achieved without the discovery of new physical principles. Rather, the water delivery system of the present invention is based on proven principles, but for which practical systems for their implementation have not previously been devised. Prior systems have failed to prevent inoperability as a result of marine or aquatic fouling; they failed to consider the requirement for strainers to preclude the clogging of the system or fouling of pumping equipment; they failed to provide for universal usage by all NFPA 1901 equipment; and they failed to comply with state and local laws or regulations pertaining to fire protection and the insurability or insurance rates applicable to such firefighting water supplies.

The essence of this system is truly revolutionary. There are no moving parts to present any mechanical problems thus adding to the simplicity of this invention. The system is maintained entirely by the application of a silicone lubricant on the metal parts. Should the system develop a major leak sufficient to interrupt the suction column, simply back flush the system and start again.

In certain prior references, such as U.S. Pat. No. 4,140,146 which issued Feb. 20, 1979 to E. E. Slanker, elaborate measures are taken to avoid the use of salt water in a fire fighting water delivery system and use primarily fresh water. Unlike the Slanker device, the present invention uses a very small amount of fresh water left in the system in standby condition, and then uses either fresh or salt water for fire fighting depending on availability. Protection rom salt water during fire fighting is considered unnecessary since the application of salt water to a fire in the type of construction described herein, would not cause any increase in damage over that which would be caused by the application of fresh water; the damage caused by fire, smoke and water (fresh or salt) would render inconsequential any additional damage that might be caused by the application of salt water.

SUMMARY OF THE INVENTION

To achieve the foregoing features and advantages and in accordance with the purposes of the invention as embodied and broadly described herein, a preferred embodiment of the firefighting water delivery system of the present invention is provided for establishing a reliable, redundant and abundant water supply from a body of water to a pump truck. In its simplest sense, the firefighting water delivery system of the present invention for use with a pump truck comprises (1) a waterside riser having a first standard fire hose fitting which provides means for removably connecting the first standard fire hose fitting, and thus the waterside riser, to the body of water by means of a standard suction hose, (2) a streetside riser having a second standard fire hose fitting positioned for removable access by the pump truck by means of standard suction hose, and (3) connecting means for fixedly connecting the streetside riser to the waterside riser for providing water/flow therebetween, such that these conduit means fluidly communicate between the body of water and the pumper truck. The pumper truck then drafts water from the natural water source through the conduit means and directs the water to the fire.

BRIEF DESCRIPTION OF THE DRAWINGS

FIG. 1 is a perspective pictorial representation illustrating the water delivery system embodying the concepts of the present invention.

Figure 1:
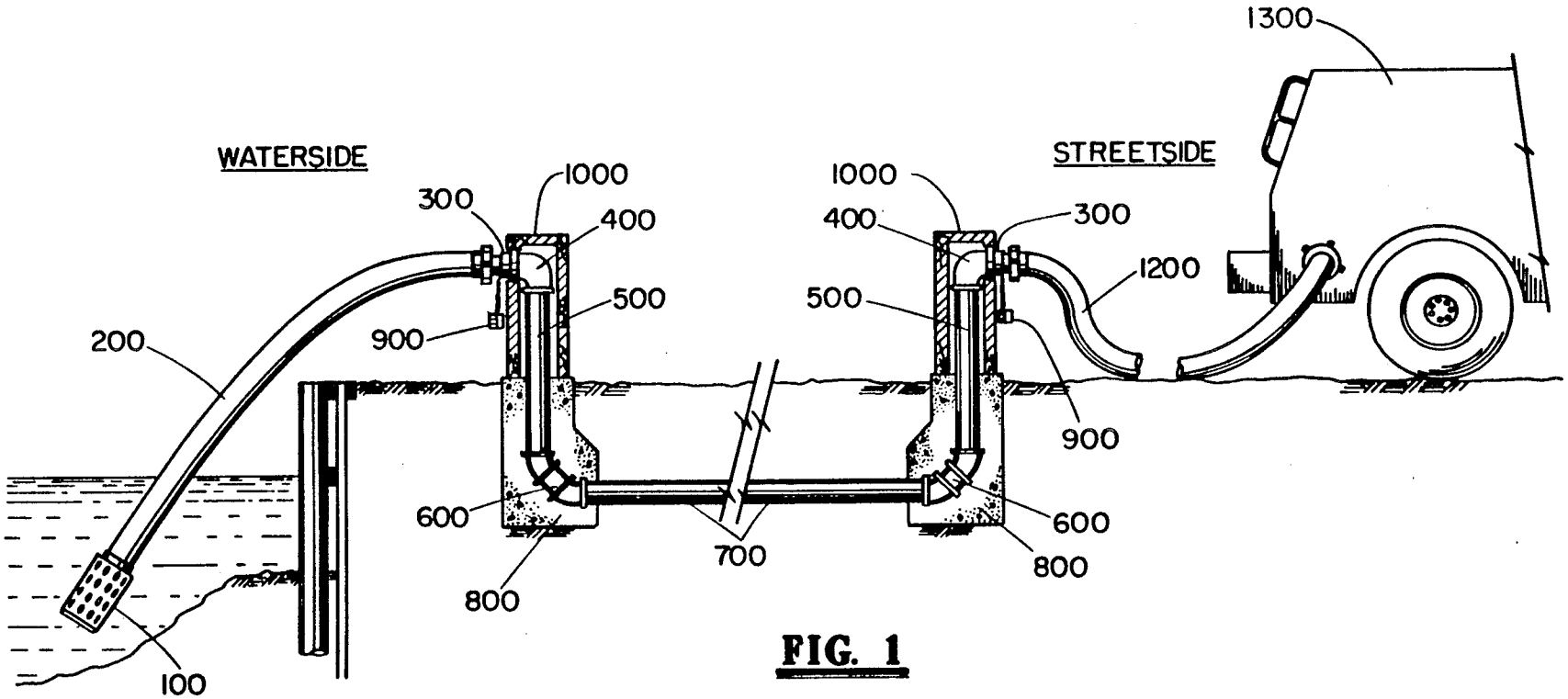
FIG. 1, which is incorporated into and constitutes a part of the specification, illustrates a preferred embodiment of the invention and together with the general description of the invention given above, and the detailed description of the preferred embodiment given below, serve to explain the principles of the invention.

The above general description and the following detailed description are merely illustrative of the generic invention, and additional modes, advantages and particulars of this invention will be readily suggested to those skilled in the art by the following detailed description.

DETAILED DESCRIPTION OF THE PREFERRED EMBODIMENTS

Reference will now be made in detail to the present preferred embodiments of the invention as described in the accompanying drawing.

The construction of the water delivery system of the present invention is shown in FIG. 1. Risers, joints and elbows can be made from Schedule 80 polyvinyl chloride or steel pipe fitted with brass NFPA 1901 standard fire hose nozzles, having standard fire hose thread on the exterior and national pipe thread on the interior and cast iron NFPA 1901 standard hydrant caps. The underground connecting pipe can be constructed of metal or Schedule 40 PVC or steel pipe, couplings and joints. The risers are set in concrete thrust blocks to provide physical stability. Paint or riser covers of various materials may be used if photolytic damage to exposed PVC is considered important. Heights of risers are approximately those of standard fire hydrants above grade. Schedule 80 PVC pipe or metal pipe provided excellent physical stability over this short vertical span.

The lateral pipe which spans between the water side riser and the street side riser, must be located below the local "freeze line" in order to protect the line from freeze damage and to insure operability during freezing and sub-freezing temperatures. The local "freeze line" is a measured depth below the Earth's surface, at which freezing temperatures will not reach. The "freeze line" depth should be readily available from various governmental agencies. Both risers should be emptied to a level below the local "freeze line" during the winter months as a precautionary measure. This can be accomplished by simply siphoning or pumping water from either riser and does not require any special equipment or procedures as needed by a conventional fire hydrant.

The elevation of the streetside nozzle is essentially equal to the height above street level of the suction intake on a pumper/tanker truck. The nozzle on the waterside riser may be lower to facilitate the use of standard hard suction fire hose. The 3 feet separation of the waterside riser from the bulkhead leaves room for suction hose handling while maintaining a sufficiently short distance to tide water to permit access via the standard length of hard suction hose carried on NFPA 1901 equipped pumper/tanker trucks. In order that any pumper truck can operate successfully, the responsible firefighting unit may carry extra strainers and adapters for trucks responding from nearby communities such that any hard suction hose with any standard size fitting can be used at either end of the water delivery system of the present invention. This is no variation from standard practice of water main/fire hydrant systems.

Reasonable variations in the dimensions and construction of the draft-extension unit from that shown in FIG. 1 is permissible providing that said variations do not preclude nor hinder the use of NFPA 1901 standard pumper/tanker trucks and equipment.

It will become apparent from the foregoing that many other variations and modifications may be made in the apparatus, materials and methods herein before described, by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

Referring to FIG. 1, the components of the firefighting water delivery system entail the following: the strainer assembly 100, which is submerged in the water source during operation; the waterside hard suction hose 200, which connects the strainer assembly 100 to the waterside riser nozzle 300; the connecting elbows 400, which connect the waterside and streetside riser nozzles 300, to the streetside and waterside risers 500. The risers 500, are vertical pipes allowing fluid flow between a first waterside riser nozzle 300 and a waterside connecting elbow 600; the waterside connecting elbow 600 connecting the horizontal conduit 700 between the streetside and waterside risers 500; the horizontal connecting conduit 700 which allows for fluid flow between the waterside riser 500 and the streetside riser 500; two concrete thrust blocks 800 which encase the connecting elbows 600 and serve as stabilizing material for the streetside and waterside risers 500; the streetside riser 500 which is also a vertical pipe allowing fluid flow between the streetside riser nozzle 300 and a streetside connecting elbow 600 inside the streetside thrust block 800; the optional waterside and streetside riser housings 1000 which may be added for appearance and/or protection considerations; the streetside riser nozzle 300 which connects the streetside connecting elbow 400 to the streetside suction hose 1200; the streetside suction hose 1200 which fluidly connects the water delivery system to the pumper/tank truck 1300 and finally the pumper/tank truck 1300 or some other type of pump mechanism which draws water through the water delivery system. NFPA 1901 cast iron nozzle caps 900, with a connecting chain can be attached a variety of ways to insure their presence during periods when the system is not in operation.

What is claimed is:

1. A method of delivering water from a body of water to a pumper truck on the ground in the vicinity of the body of water comprising the following steps:

engaging the body of water with a waterside conduit having a strainer to prevent fouling for removing from the body of water a portion thereof, transferring the removed water through the waterside conduit to a first riser having the physical characteristics of a fire hydrant for accepting the water from the waterside conduit and for transferring the water to an underground conduit, passing the water from the first riser to an underground conduit for transferring the water to a location removed from the first riser where water is required for fighting fires, raising the water through a second riser having the physical characteristics of a fire hydrant for providing an above ground outlet for the water, engaging the second riser with a suction hose in operative association with a pumper truck for pumping the water from the body of water through the waterside conduit for transferring the water in the underground conduit to the second riser and ultimately to the pumper truck for use in fighting fires at a location in the vicinity of the body of water.

2. A firefighting water delivery system for providing a reliable, redundant and abundant water supply from a body of water to a pump truck comprising:

(a) a first riser having a first standard fire hose fitting maintained in proximity to the body of water, (b) conduit mans for removably engaging the first standard fire hose fitting for fluidly coupling the body of water with said first riser, (c) a second riser having a second standard fire hose fitting positioned for access by the pump truck, (d) connecting means for fixedly engaging said firs riser to said second riser for providing water flow therebetween, such that said conduit means fluidly communicates with the body of water and the pump truck removably engages the second standard fire hose fitting for drafting water through said conduit means, said first riser, said connecting means and said second riser for use by the pump truck.

3. A firefighting water delivery system as defined in claim 2 further comprising a concrete thrust block for accepting, securing and stabilizing each said first riser and said second riser partially below the ground surface.

4. A firefighting water delivery system as defined in claim 2 further comprising an above ground structure for accepting, securing and stabilizing said first riser and said second riser for providing a facade resembling a standard fire hydrant for clear identification as a fire fighting water source.

5. A firefighting water delivery system as defined in claim 2 wherein said first riser and said second riser comprise substantially vertical piping or tubing members, each said vertical piping or tubing member having a lower portion fixedly engaged below the ground surface and an upper portion operationally extending above the ground surface.

6. A firefighting water delivery system as defined in claim 2 wherein said connecting means is a substantially horizontal tubing member for providing a continuous channel from said first riser through said second riser.

7. A firefighting water delivery system as defined in claim 2 wherein said conduit means comprises:

(a) a fitting for removably engaging the first standard fire hose fitting of said first riser, (b) a hard suction hose in operative association with said fitting, and (c) a strainer in operative association with said hard suction hose for preventing fouling by foreign matter in the water.

8. A firefighting water delivery system as defined in claim 2 wherein the flow of water is determined by pump capacity and, thus, can be at least the equivalent of the flow of water associated with standard fire hydrant systems.

9. A firefighting water delivery system as defined in claim 2 wherein multiple units of the system will fully accommodate as many pump trucks as can be brought to the scene of a fire in that each unit operates independently of the others and each connects with an unlimited water source.

10. A firefighting water delivery system as defined in claim 2, for use in associated with waterside communities and which can be installed without regard to the location of or the design of the potable water distribution system.

11. A firefighting water delivery system for providing a reliable, redundant and abundant water supply from a body of surface water to a pump truck comprising:

(a) a first riser having a first standard fire hose fitting maintained in proximity to the body of water, (b) a second riser having a second standard fire hose fitting positioned for access by the pump truck, (c) a conduit means for fixedly engaging said first riser to said second riser for providing water flow therebetween, such that said conduit means fluidly communicates with the body of water and the pump truck removably engages the second standard fire hose fitting for drafting water through said first riser, said conduit means and said second riser for use by the pump truck.

12. A firefighting water delivery system as defined in claim 11 further comprising an above ground structure for accepting, securing and stabilizing said waterside riser and streetside riser for providing a facade resembling a standard fire hydrant that readily identifies said above ground structure as a firefighting water source.

13. A firefighting water delivery system as defined in claim 12 wherein waterside and streetside risers which are substantially vertical pipe or tubing members, each having a lower portion fixedly engaged below the ground surface and an upper portion operationally extending above the ground surface.

14. A firefighting water delivery system as defined in claim 12 further comprising a connecting means of a substantially horizontal piping or tubing member for providing a continuous channel from said first riser through said second riser.

15. A firefighting water delivery system as defined in claim 12 further comprising a fitting for removably engaging the first standard fire hose fitting of said first riser.

16. A firefighting water delivery system as defined in claim 12 further comprising a hard suction hose in operative association with said fitting.

17. A firefighting water delivery system as defined in claim 12 further comprising a strainer assembly in operative association with said hard suction hose for preventing fouling by foreign matter in the water.

18. A firefighting water delivery system as defined in claim 12 further comprising a plurality of first risers, a plurality of second risers and a plurality of conduit means, respectively, for providing a plurality of locations for fluidly connecting a pumper truck.

* * * * *